US011304494B2

(12) United States Patent
Wise

(10) Patent No.: US 11,304,494 B2
(45) Date of Patent: Apr. 19, 2022

(54) REPEATEDLY REFILLABLE REUSABLE DISPENSER

(71) Applicant: Robert Wise, Penngrove, CA (US)

(72) Inventor: Robert Wise, Penngrove, CA (US)

( * ) Notice: Subject to any disclaimer, the term of this patent is extended or adjusted under 35 U.S.C. 154(b) by 63 days.

(21) Appl. No.: 16/683,689

(22) Filed: Nov. 14, 2019

(65) Prior Publication Data

US 2021/0145148 A1 May 20, 2021

(51) Int. Cl.
*A45D 40/04* (2006.01)
*B65D 83/00* (2006.01)
*A45D 40/00* (2006.01)

(52) U.S. Cl.
CPC ..... *A45D 40/04* (2013.01); *B65D 83/0022* (2013.01); *A45D 2040/005* (2013.01); *A45D 2040/0043* (2013.01)

(58) Field of Classification Search
CPC ..... A45D 40/04; A45D 2040/0043; A45D 2040/005; A45D 40/02; B65D 83/0022
See application file for complete search history.

(56) References Cited

U.S. PATENT DOCUMENTS 1,863,106 A * 6/1932 Gimonet ..... A45D 40/04 401/173
1,904,364 A * 4/1933 Fullmer ..... A45D 40/023 401/60
4,343,460 A * 8/1982 Gende ..... B05B 9/0838 267/151
4,702,398 A * 10/1987 Seager ..... A45D 40/02 222/105
5,505,041 A * 4/1996 Harlan ..... A45D 40/04 206/385
5,833,382 A * 11/1998 Jenks ..... A45D 40/02 401/82
5,947,621 A * 9/1999 Szekely ..... A45D 40/04 401/68
7,708,169 B1 * 5/2010 Szoke, Jr. ..... B05C 17/0113 222/326
8,919,617 B2 * 12/2014 Foley ..... B65D 83/0033 222/386
9,872,551 B2 * 1/2018 Swaile ..... A45D 40/065
2004/0120756 A1 * 6/2004 Cheng ..... A45D 40/10 403/109.1
2006/0076370 A1 * 4/2006 Etesse ..... B65D 47/2031 222/494
2018/0249808 A1 * 9/2018 Crawford ..... A45D 40/04
(Continued)

*Primary Examiner* — Patrick M. Buechner
(74) *Attorney, Agent, or Firm* — Boudwin Intellectual Property; Daniel Boudwin

(57) ABSTRACT

A refillable repetitively reusable dispensing apparatus including a dispenser housing having a sidewall, a base and an open top end. A removable cap is placed on the open top end. The cap has a plurality of apertures located therein. The side wall has an aperture located therethrough. There is a movable dispenser base located within the housing, wherein the movable dispenser base creates a seal with the sidewall. A screw rod having a knob attached, wherein when the knob is turned the screw rod is rotated. The screw rod and the knob are rotatably attached within the dispenser housing such that the knob protrudes through the aperture. A scissor lift is attached to the screw rod at one pair of ends. The scissor lift is attached to the movable dispenser base at the second pair of ends.

20 Claims, 5 Drawing Sheets

(56) References Cited

U.S. PATENT DOCUMENTS

| | | | | |
|---|---|---|---|---|
| 2018/0249809 | A1* | 9/2018 | Crawford | A45D 40/02 |
| 2018/0295968 | A1* | 10/2018 | Groffsky | B65D 83/0038 |
| 2021/0137243 | A1* | 5/2021 | Nolan | A45D 40/16 |

* cited by examiner

REPEATEDLY REFILLABLE REUSABLE DISPENSER

BACKGROUND OF THE INVENTION

The present invention relates to a dispenser housing. More particularly, the present invention provides a housing that has is adapted to accept refill cartridges.

A large number of humans use deodorant, Icy Hot, Bio Freeze or similar spreadable substances every day. These substances often come in plastic canisters. These canisters are meant to be used once then tossed aside. While these canisters are functional and inexpensive, they also create waste.

Plastic takes decades to decompose and all the while takes space in landfills. The trash issue in our planet is starting to reach critical levels as more and more things are made to be disposable. These items especially the canisters take up even more room due to the nature of having an interior volume. Due to the number of canisters used these items account for a significant amount of landfill.

Consequently, there is a need in for an improvement in the art of waste saving devices. The present invention substantially diverges in design elements from the known art while at the same time solves a problem any people face when using dispensers to apply substances to a body. In this regard the present invention substantially fulfills these needs.

SUMMARY OF THE INVENTION

The present invention provides a refillable dispenser housing. wherein the same can be utilized for providing convenience for the user when using dispensers to apply substances to a surface. The repeatedly refillable reusable dispenser comprises a dispenser housing having a sidewall, a base and an open top end. A cap is removably secured to the open top end of the housing. The cap has a plurality of apertures located therein. The side wall has an aperture located therethrough. A movable dispenser base is disposed within the housing, wherein the movable dispenser base creates a seal with the sidewall. A screw rod which has a knob attached. The knob will rotate the screw rod when turned. The screw rod and the knob are rotatably attached within the dispenser housing such that the knob protrudes through the aperture. A scissor lift is attached to the screw rod at a first pair of ends. The scissor lift is attached to the movable dispenser base at a second pair of ends.

Another object of the repeatedly refillable reusable dispenser is to have a lid, where the lid is configured to be placed upon the open top end of the dispenser housing.

Another object of the repeatedly refillable reusable dispenser is to have the first pair of ends of the scissor lift have a pair of threaded apertures configured to attach to the screw rod.

Another object of the repeatedly refillable reusable dispenser is to have the second pair of ends of the scissor lift have an attachment device located thereon, wherein the attachment device attaches to the movable dispenser base.

Another object of the repeatedly refillable reusable dispenser is to have the movable dispenser base have a pair of attachment apertures located on a bottom side thereof.

Another object of the repeatedly refillable reusable dispenser is to have the attachment apertures be elongated apertures, such that the attachment devices located on the scissor lift are slidably connected to the attachment apertures.

Another object of the repeatedly refillable reusable dispenser is to have a disposable cartridge filled with deodorant.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
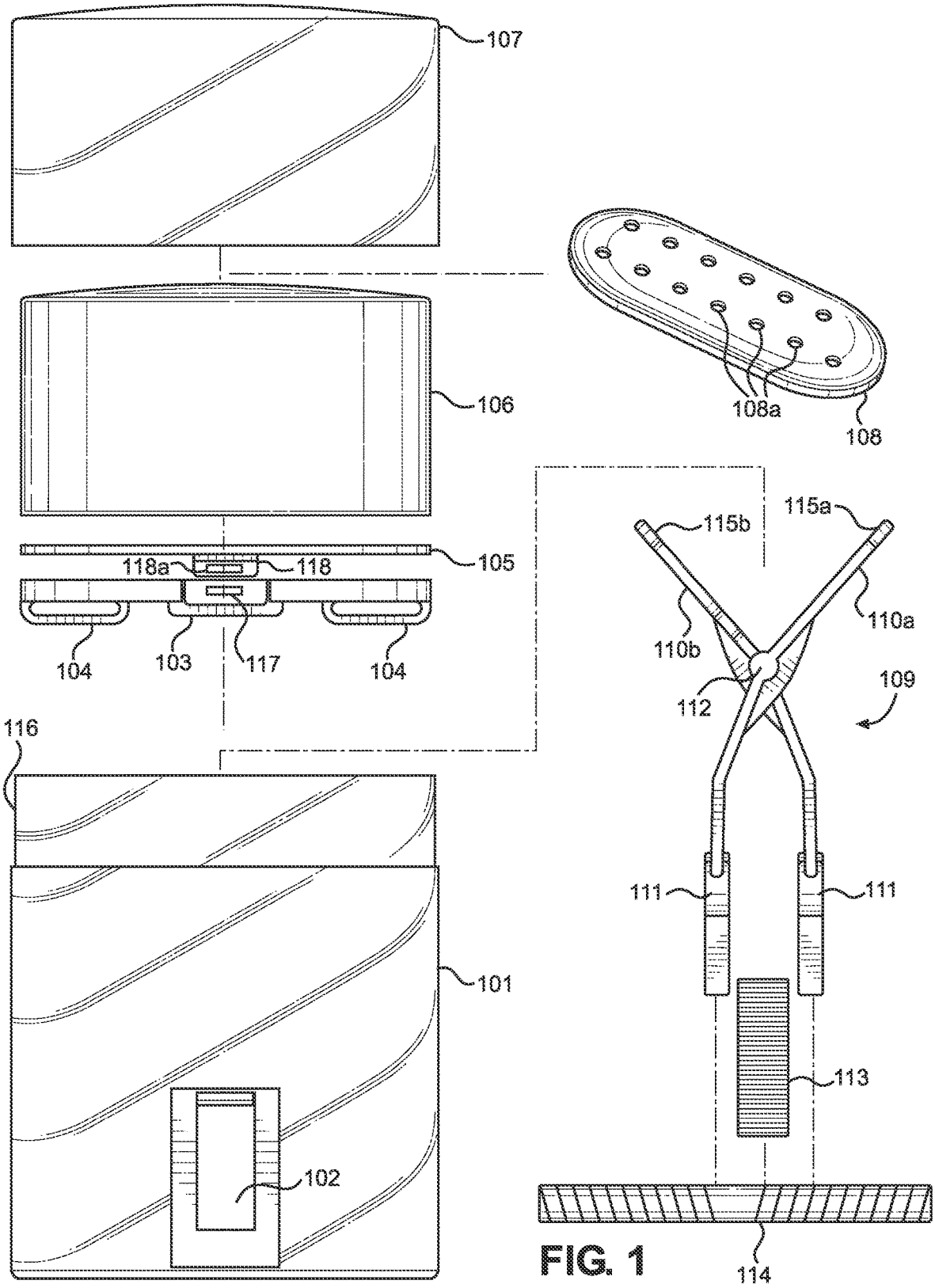
FIG. 1 shows an exploded view of an embodiment of the repeatedly refillable reusable dispenser.

Reference is made herein to the attached drawings. Like reference numerals are used throughout the drawings to depict like or similar elements of the refillable dispenser housing. For the purposes of presenting a brief and clear description of the present invention, a preferred embodiment will be discussed as used for the refillable dispenser housing. The figures are intended for representative purposes only and should not be considered to be limiting in any respect.

Referring now to FIG. 1, there is shown an exploded view of an embodiment of the repeatedly refillable reusable dispenser. The refillable dispenser housing includes a housing 101. The housing has a base, a sidewall and an open top end. The sidewall has an aperture 102 located therethrough. In one embodiment, there is a first aperture 102 located through the sidewall on one side and a second aperture is located on the sidewall opposite the first aperture and in alignment therewith. In one embodiment, the sidewall is configured to have a lip 116 located about a top end. The lip 116 is configured to accept a lid 107 thereon. The lid 107 is configured to have a friction fit. In one embodiment, the lid 107 takes the form of a refillable solution reservoir.

In one embodiment there is a cap 108 configured to fit within the open top end. The cap is configured to be removably placed within the open top end. In the illustrated embodiment, the cap 108 has a lip placed there around. The lip will prevent the cap from being placed too far into the housing 101. The cap 108 has a plurality of apertures **108*a* located therethrough. The plurality of apertures 108*a* will allow gel substances to be pushed therethrough. The cap 108 has a smooth upper surface. In one embodiment, the cap 108** has a rounded arch shape. This shape will better conform to and spread deodorant to an underarm.

The interior of the housing 101 contains a movable dispenser base 103. The movable dispenser base 103 is shaped to movably fit within the housing 101. The movable dispenser base 103 has a top side and a bottom side. The bottom side of the movable dispenser base 103 has a pair of attachment apertures 104. In one embodiment the attachment apertures 104 are elongated apertures. This will allow the attachment device 115*a*, 115*b* (described below) to slide horizontally within the apertures. This will better enable the scissor lift 109 (described below) to rise and lower.

The top side of the movable dispenser base 103 is configured to fit a substance attachment clip 105. In one embodiment, the substance attachment clip 105 is made from a biodegradable substance. In a further embodiment the substance is formed polyvinyl alcohol. In another embodiment the substance is paper covered in polyvinyl alcohol. In one embodiment the substance attachment clip 105 is dissolvable in an aqueous media. This will allow the attachment clip to eliminate space in landfills.

The movable dispenser base 103 has a protruding pin 117 located on at least one side thereof. The protruding pin 117 is configured to fit within an aperture 118*a* located on a tongue 118 attached to the substance attachment clip 105. In one embodiment the substance attachment clip 105 creates a waterproof seal with the sides of the housing 101. This will prevent gel substances from leaking into the housing below the movable dispenser base 103. In one embodiment the substance attachment clip 105 is configured to removably attach to the top side of the movable dispenser base 103.

The interior of the housing 101 further contains a scissor lift 109. The scissor lift 109 is comprised of a first side 110*a* and a second side 110*b*. The first side 110*a* and the second side 110*b* are attached with a rotating pin device 112. This device will allow the first side 110*a* and the second side 110*b* to rotate. The scissor lift 109 has an attachment device 115*a*, 115*b*. The attachment device is configured to slidably connect to the attachment apertures of the movable dispenser base 103. In one embodiment the attachment device 115*a*, 115*b* is a hook. At the opposite end of each side 110*a*, 110*b* there is an attachment 111 located at the bottom of each side 110*a*, 110*b*. In one embodiment the attachment 111 has a threaded portion.

The threaded portion within the attachment 111 is configured to attach to a screw rod 114. The screw rod 114 has threads located thereon. The threads are configured such that when the screw rod 114 is rotated, both attachments 111 will move towards each other; or away from each other respectively. In this manner, the scissor lift 109 will extend or collapse. In one embodiment the threads are configured to move the scissor lift in a large amount with only a small turn. For example, in one embodiment, one full rotation of the screw rod 114 will move the scissor lift 109 halfway into the extend position from fully collapsed. The screw rod 114 has a knob 113 attached. The knob 113 is configured to be wider that the screw rod 114. In one embodiment the knob 113 has a texture located around the outer edge. The texture will make the knob easier to turn.

The refillable dispenser is configured to hold a spreadable substance 106. In one embodiment, the spreadable substance 106 is a solid substance. In another embodiment, the spreadable substance 106 is wrapped in a biodegradable container. The container is removed and the spreadable substance 106 is inserted into the housing. In one embodiment the spreadable substance 106 is attached to the movable dispenser base 103 using a substance attachment clip 105.

In some embodiments the spreadable substance 106 is a gel substance. In this embodiment, the gel substance is located within a removable cartridge. In one embodiment the cartridge is a biodegradable cartridge. In one embodiment the cartridge is dissolvable in an aqueous media. In some embodiments that cartridge is a collapsible cartridge. This will allow for a gel substance to remain the in cartridge and be squeezed therefrom. In another embodiment the cartridges is designed to be removed from a solid spreadable substance and only the substance is placed in the housing 101. The cartridge is placed within the house 101 by attaching the attachment clip 105 to the movable dispenser base 103. The cap 108 is then attached to the open top end of the housing 101. As the spreadable substance 106 is pushed up and out of the cap 108 the cartridge will collapse.

Figure 2:
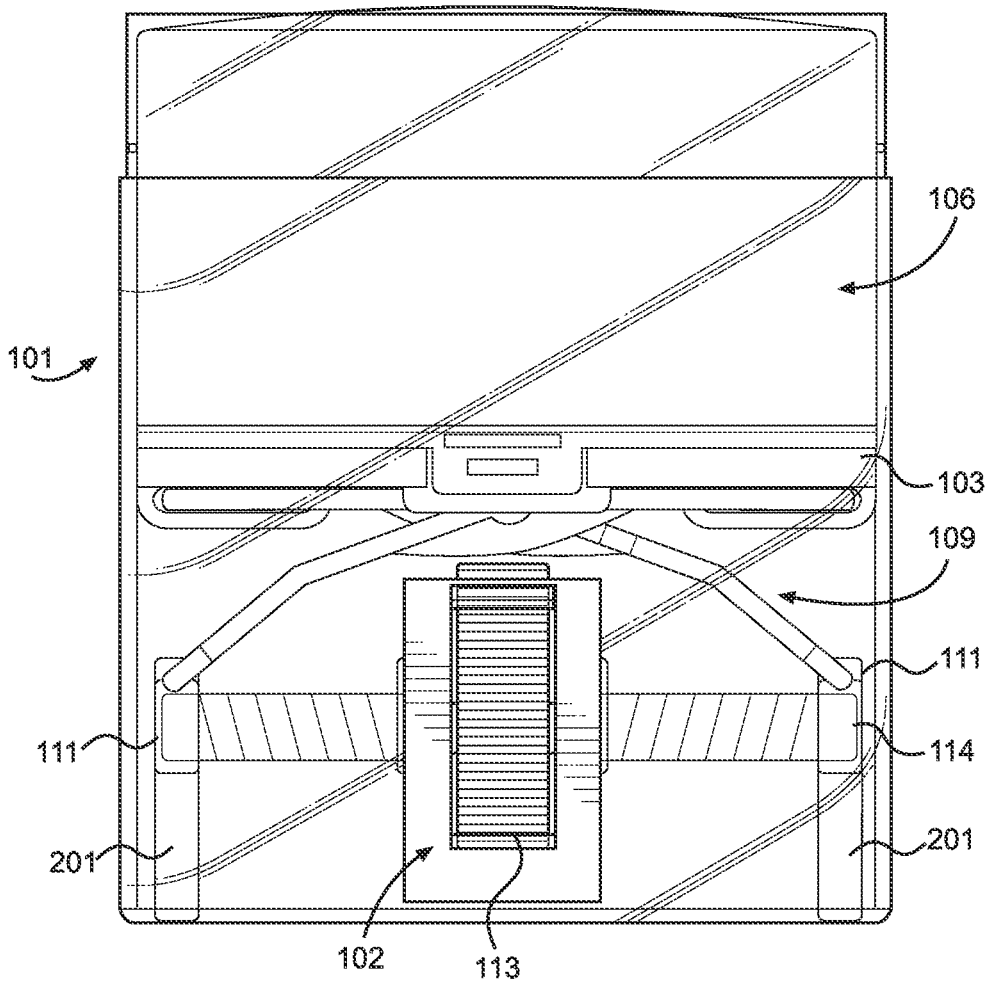
FIG. 2 shows a front view of an embodiment of the repeatedly refillable reusable dispenser in a collapsed position.

Referring now to FIG. 2, there is shown a front view of an embodiment of the repeatedly refillable reusable dispenser in a collapsed position. In the collapsed position, the scissor lift 109 is flattened such that it rests directly over the knob 113. In this position the scissor lift 109 will be at the outer edge of the screw rod 114. The movable dispenser base 103 will be lowered into the housing 101. The spreadable substance 106 will be positioned such that it is fully encapsulated within the housing 101.

In one embodiment the threaded attachment 111 has an elongated member 201 attached to a lower part thereof. The elongated member 201 is configured to allow the threaded attachment 111 to still attach to the screw rod 114. This is due to the fact that the elongated member 201 is located below the threaded attachment 111. The elongated member 201 is long enough that it will reach the bottom of the housing 101. This will take the weight of the spreadable substance 106 away from the scissor lift 109. The weight from the spreadable substance 106 will be displaced to the bottom of the housing 101.

Figure 3:
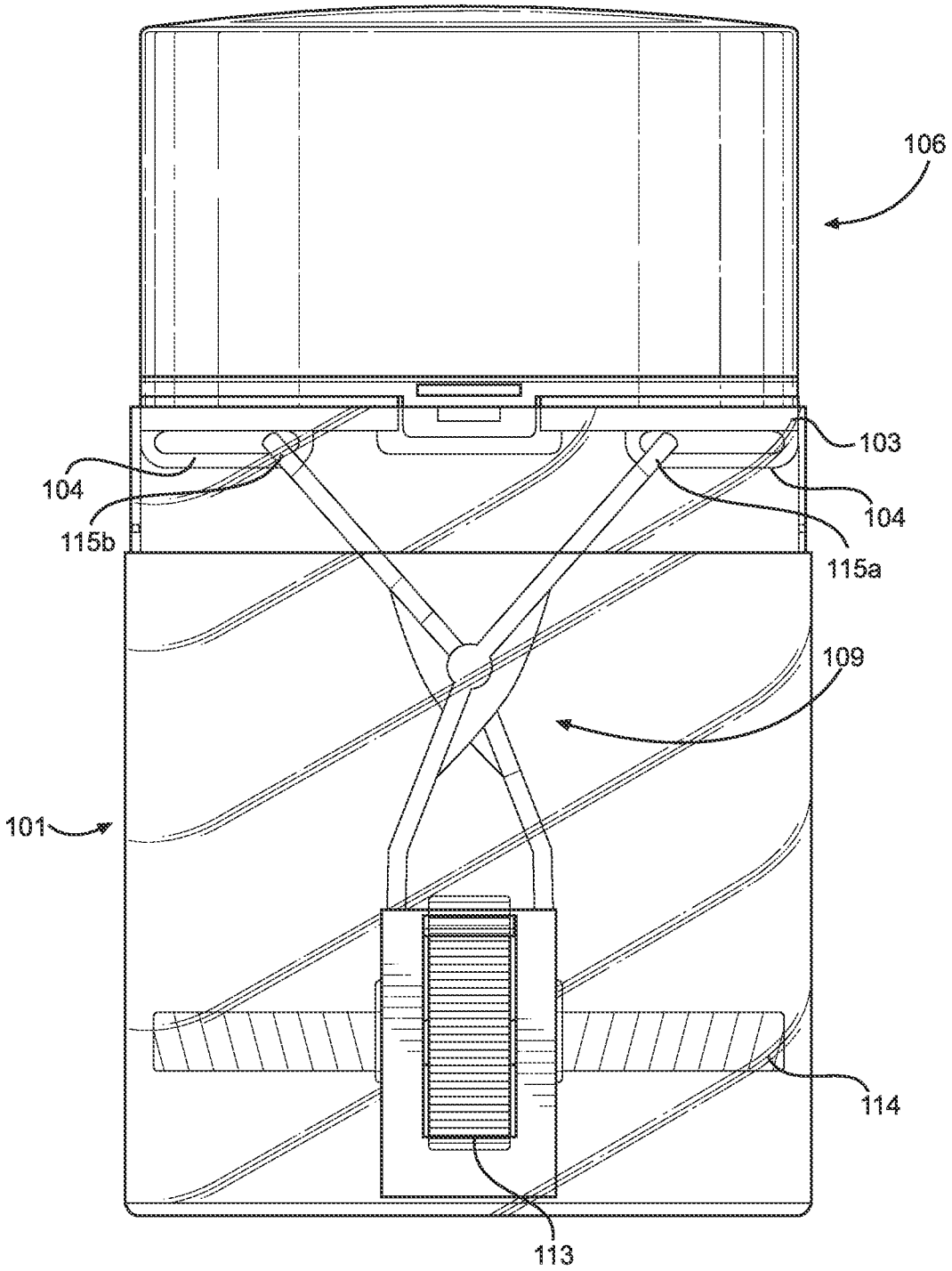
FIG. 3 shows a front view of an embodiment of the repeatedly refillable reusable dispenser in an expanded position.

Referring now to FIG. 3, there is shown a front view of an embodiment of the repeatedly refillable reusable dispenser in an expanded position. In the expanded position the scissor lift 109 is in an extended position. As the movable dispenser base 103 is lifted by the scissor lift 109 the attachment device 115*a*, 115*b* will slide within the connection apertures 104. As the scissor lift 109 is pulled closer to the knob on the screw rod 114, the scissor lift 109 will force the movable dispenser base 103 upward. This will push the spreadable substance 106 out of the open top end of the housing 101.

Figure 4:
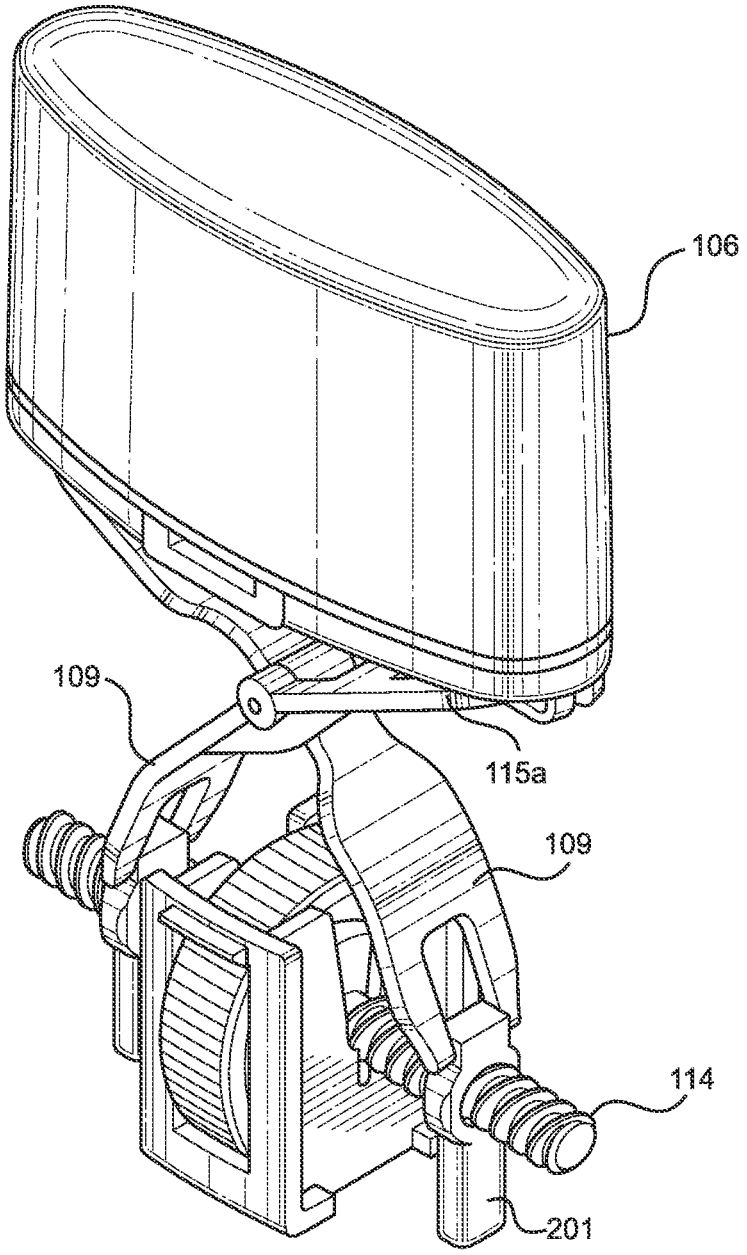
FIG. 4 shows a perspective view of an embodiment of the mechanism designed be placed within the housing.

Referring now to FIG. 4, there is shown a perspective view of an embodiment of the mechanism designed be placed within the housing. In the shown embodiment, the screw rod 114 is shown to have coarse or large threads. These threads will allow for the scissor lift 109 to be moved a large amount with a small turn. Further, there is shown a side view of the elongated member 201. The elongated member 201 is configured to be large enough to take the weight from the spreadable substance 106. In the shown embodiment the scissor lift 109 has a wide flat first side 110*a* and second side 110*b*.

Figure 5:
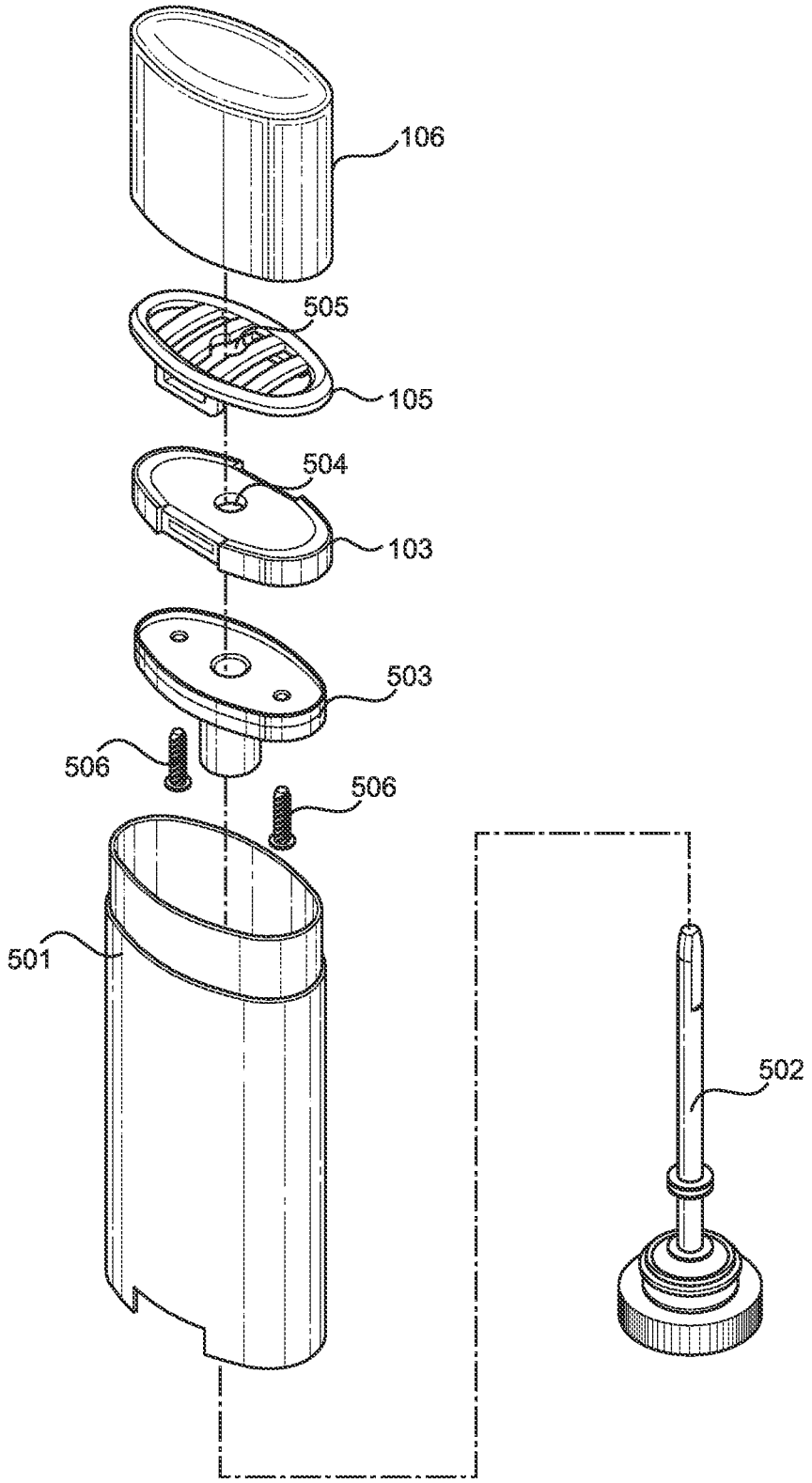
FIG. 5 shows an exploded view of an embodiment of a dispensing mechanism designed to work with an existing container.

Referring now to FIG. 5, there is shown an exploded view of an embodiment of a dispensing mechanism designed to work with an existing container. The existing container 501 has an existing vertical screw rod 502. The vertical screw rod 502 is configured to rise and lower an existing base 503. In this embodiment the movable base 103 is configured to attach to the existing base 503. In the shown embodiment the existing base 503 and the movable base 103 are attached using screws 506. In another embodiment other securement devices may be used.

In the shown embodiment the movable base 103 is configured to have an aperture 504 placed in the middle thereof. The aperture 504 is configured to allow the vertical screw rod 502 to be placed therethrough. Further, the attachment clip 105 is configured to have an aperture 505 placed therethrough. The aperture 505 is configured to have the vertical screw rod 502 placed therethrough. In this embodiment the spreadable substance 106 is able to be replaced as needed, without replacing the entire container.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A repeatedly refillable reusable dispenser, the dispenser comprising:

a dispenser housing having a sidewall, a base and an open top end;

wherein the housing has an aperture located therethrough;

a screw rod having a knob attached, wherein when the knob is turned the screw rod is rotated;

wherein the screw rod and the knob are rotatably attached within the dispenser housing such that the knob protrudes through the aperture;

a lift is movably attached to the screw rod at a first pair of ends of the lift;

wherein the lift is attached to a movable-base at a second pair of ends thereof;

wherein the second pair of ends of the lift have a substance-attachment clip located thereon, wherein the substance-attachment clip attaches to the movable base;

wherein the lift aligns the movable base at the dispenser's open top end so to remove and reaffix the substance-attachment clip.

2. The repeatedly refillable reusable dispenser of claim 1, further comprising a lid, wherein the lid is configured to be placed upon the open top end of the dispenser housing.

3. The repeatedly refillable reusable dispenser of claim 1, wherein the first pair of ends of the lift has a pair of threaded apertures configured to attach to the screw rod.

4. The repeatedly refillable reusable dispenser of claim 1, where alignment of the moveable base with the open end of the dispenser housing allows a refill substance to be removeably affixed to the movable base via the substance attachment clip.

5. The refillable dispenser housing of claim 1, further comprising a cap to be placed within the open top end.

6. The repeatedly refillable reusable dispenser of claim 5, wherein the cap has a plurality of apertures therethrough.

7. The repeatedly refillable reusable dispenser of claim 1, wherein the movable base has a pair of attachment apertures located on a bottom side thereof.

8. The repeatedly refillable reusable dispenser of claim 7, wherein the attachment apertures are elongated apertures, such that the substance attachment clip located on the lift is connected to the attachment apertures.

9. The repeatedly refillable reusable dispenser of claim 1, further comprising a disposable cartridge filled with a spreadable substance.

10. The repeatedly refillable reuseable dispenser of claim 9, wherein the disposable cartridge is dissolvable in an aqueous media.

11. The repeatedly refillable reusable dispenser of claim 1, wherein the removably affixed substance attachment clip is removable as the dispenser base is in alignment with the open end of the dispenser housing so to affix a new substance attachment clip with new solution.

12. The repeatedly refillable reusable dispenser of claim 11, wherein the attachment clip is dissolvable in an aqueous media.

13. A repeatedly refillable reusable dispenser, the dispenser comprising:

a dispenser housing having a sidewall, a base and an open top end;

a cap removably secured to the open top end;

wherein the cap has a plurality of apertures located therein;

wherein the housing has an aperture located therethrough;

a dispenser base disposed within the housing, wherein the dispenser base creates a seal with the sidewall;

a screw rod having a knob attached, wherein when the knob is turned the screw rod is rotated;

wherein the screw rod and the knob are rotatably attached within the dispenser housing such that the knob protrudes through the aperture;

a lift attached to the screw rod at a first pair of ends;

the lift is attached to the dispenser base at a second pair of ends;

wherein the second pair of ends of the lift have an substance-attachment clip located thereon, wherein the substance-attachment clip attaches to the dispenser base;

wherein the dispenser base aligns with the open top end of the dispenser housing.

14. The repeatedly refillable reusable dispenser of claim 13, further comprising a lid, wherein the lid is configured to be placed upon the open top end of the dispenser housing.

15. The repeatedly refillable reusable dispenser of claim 13, wherein the first pair of ends of the lift has a pair of threaded apertures configured to attach to the screw rod.

16. The repeatedly refillable reusable dispenser of claim 13, further comprising a disposable cartridge filled with a spreadable substance.

17. The repeatedly refillable reusable dispenser of claim 16 wherein the disposable cartridge is dissolvable in an aqueous media.

18. The repeatedly refillable reusable dispenser of claim 13, where alignment of the dispenser base with the open end of the dispenser housing allows a substance within a replaceable cartridge device to be moveably affixed to the dispenser via the substance attachment clip.

19. The repeatedly refillable reusable dispenser of claim 18, wherein the dispenser base has a pair of attachment apertures located on a bottom side thereof.

20. The repeatedly refillable reusable dispenser of claim 19, wherein the attachment apertures are elongated apertures, such that the substance attachment clip located on the lift is slidably connected to the attachment apertures.

* * * * *